US007997512B2

(12) United States Patent
Jaeger

(10) Patent No.: US 7,997,512 B2
(45) Date of Patent: Aug. 16, 2011

(54) ROTOR NOZZLE

(75) Inventor: Anton Jaeger, Senden (DE)

(73) Assignee: Anton Jager, Senden (DE)

( * ) Notice: Subject to any disclaimer, the term of this patent is extended or adjusted under 35 U.S.C. 154(b) by 134 days.

(21) Appl. No.: 12/388,641

(22) Filed: Feb. 19, 2009

(65) Prior Publication Data

US 2009/0212129 A1 Aug. 27, 2009

(30) Foreign Application Priority Data

Feb. 22, 2008 (DE) ..... 10 2008 010 690

(51) Int. Cl.
*B05B 3/04* (2006.01)

(52) U.S. Cl. ..... 239/240; 239/225.1

(58) Field of Classification Search ..... 239/240, 239/204, 205, 206, 225.1, 263, 251, 463, 239/482; 4/490, 492

See application file for complete search history.

(56) References Cited

U.S. PATENT DOCUMENTS

| | | | | |
|---|---|---|---|---|
| 4,466,142 | A * | 8/1984 | Gould | 4/490 |
| 5,048,757 | A * | 9/1991 | Van Leeuwen | 239/205 |
| 5,415,130 | A * | 5/1995 | Brackett | 119/670 |
| 6,848,124 | B2 * | 2/2005 | Goettl | 4/490 |

FOREIGN PATENT DOCUMENTS

| | | | |
|---|---|---|---|
| DE | 197 09 120 | A1 * | 9/1998 |
| DE | 297 15 144 | U1 * | 9/1998 |
| DE | 19742420 | A1 * | 4/1999 |
| DE | 198 21 919 | A1 * | 11/1999 |
| DE | 10 2006 025 931 | A1 * | 12/2007 |
| DE | 10 2006 053 625 | A1 | 5/2008 |
| EP | 1000665 | A2 * | 5/2000 |

OTHER PUBLICATIONS

German Search Report dated Jan. 23, 2009. Application No. DE 10 2008 010 690.9.

* cited by examiner

*Primary Examiner* — Davis Hwu
(74) *Attorney, Agent, or Firm* — Gifford, Krass, Sprinkle, Anderson & Citkowski, P.C.

(57) ABSTRACT

The invention relates to a rotor nozzle, in particular for high-pressure cleaning devices, having a nozzle housing which has an inlet opening for liquid at its axially one end and an outlet opening for liquid at the other end as well as having a rotor which is arranged in a swirl chamber of the nozzle housing, whose front end facing the outlet opening is supported at a bearing, which can at least be partly flowed through by the liquid, which can be set into rotation around a longitudinal axis by liquid flowing into the swirl chamber and which is inclined toward the longitudinal axis at least in the rotating state; wherein the rotor has an inlet region for the liquid via which the liquid can move out of the swirl chamber into the rotor to allow a rotor flow of the liquid from the inlet region up to the front end of the rotor and out of the outlet opening; wherein the rotor nozzle is capable of a switchover procedure between a stationary state in which the rotor is held tight between the bearing and an abutment and a rotational state in which the rotor is out of engagement with the abutment; and wherein the switchover procedure is triggerable by the rotor flow building up on the start-up of the rotor nozzle and/or by pressure relationships and/or flow relationships being adopted at and/or in the rotor.

27 Claims, 4 Drawing Sheets

ROTOR NOZZLE

CROSS-REFERENCE TO RELATED APPLICATIONS

Figure 1:
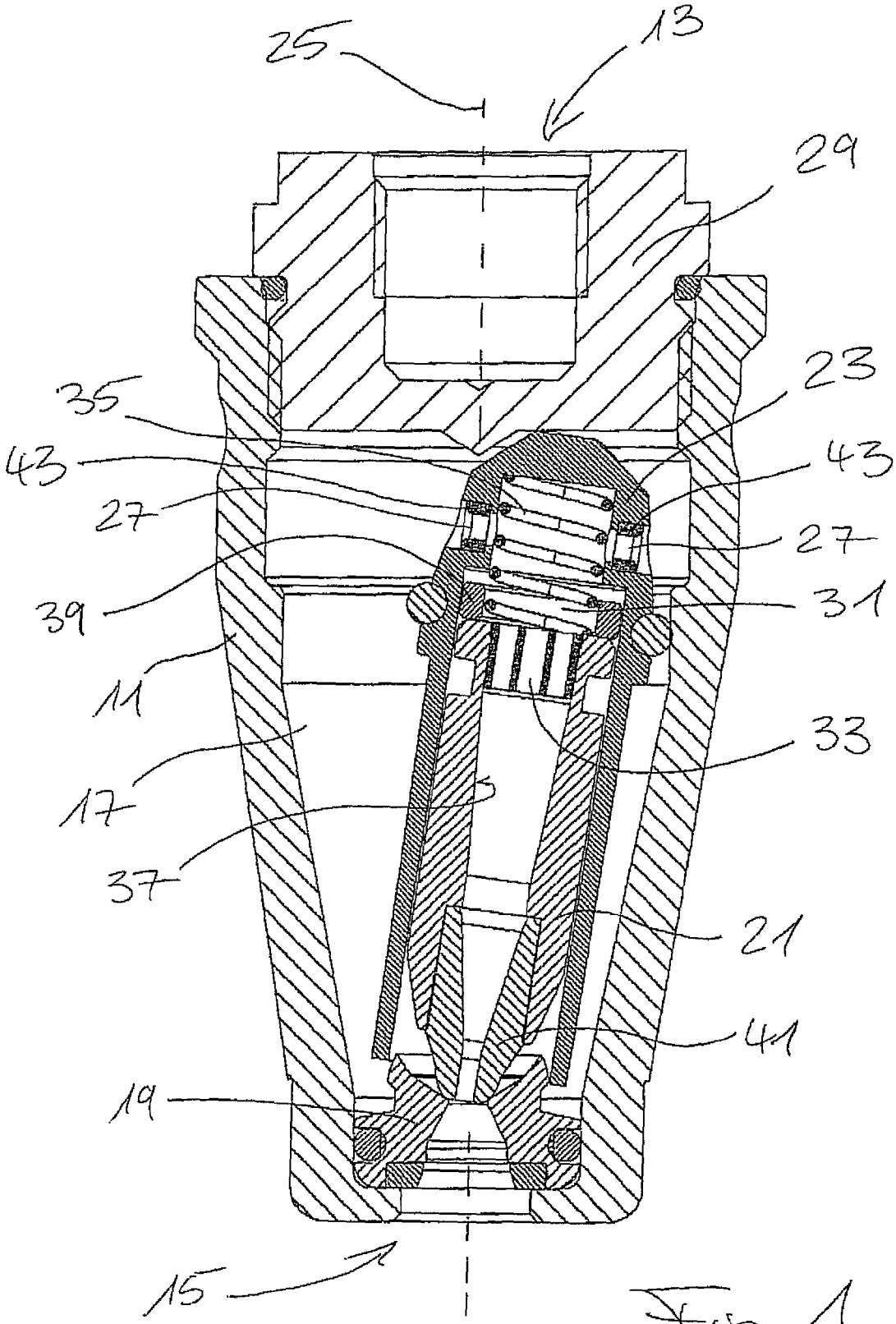

This application claims priority of German Patent Application DE 10 2008 010 690.9 filed Feb. 22, 2008.

FIELD OF THE INVENTION

The invention relates to a rotor nozzle, in particular for high-pressure cleaning devices.

SUMMARY OF THE INVENTION

Rotor nozzles of this type are generally known.

It is the object of the invention to provide a rotor nozzle which has a reliable starting and start-up behavior.

This object is satisfied by the features of claim 1.

In accordance with the invention, the rotor can be switched over, and indeed between a stationary state, on the one hand, and a rotational state, on the other hand. The holding tight of the rotor between the bearing and the abutment, which can e.g. be a connection plug which can be pushed or screwed into the nozzle housing, ensures that the front end of the rotor contacts the bearing at the start. It is hereby ensured that the liquid exits the outlet opening over the rotor—and not directly from the swirl chamber while bypassing the rotor. The switchover function in accordance with the invention in turn ensures that the rotor moves out of engagement with the rear abutment in good time and can then rotate freely. Disturbing friction effects which can hinder or even prevent a start-up as intended of the rotor and even a proper rotational operation are reliably precluded in this manner.

The invention utilizes the rotor flow which builds up at the start-up or start of the rotor nozzle, that is the flow of the liquid through the rotor or the flow relationships and/or pressure relationships which are adopted in this respect at and/or in the rotor to trigger the switchover process. This switching principle is in particular independent of centrifugal forces acting on the rotor, i.e. a rotation of the rotor of any kind is not required in accordance with the invention to trigger the switching process. The invention rather makes use of the flow relationships or pressure relationships present at the start-up or start of the rotor nozzle to bring the rotor out of engagement with the abutment, i.e. to trigger the holding tight, in particular a clamping, of the rotor.

A particular advantage of the invention comprises the fact that the pressure relationships and/or flow relationships at or in the rotor which prevail during the start-up or start phase can be influenced in a simple and effective manner in particular by simple construction measures. The flow cross-section of the inlet region into the rotor can be changed, for example. The conditions or the time under or at which the switching process is triggered can hereby be directly fixed.

Further advantageous embodiments of the invention are also set forth in the dependent claims, in the description and in the drawing.

BRIEF DESCRIPTION OF TEE DRAWINGS

Figure 2:
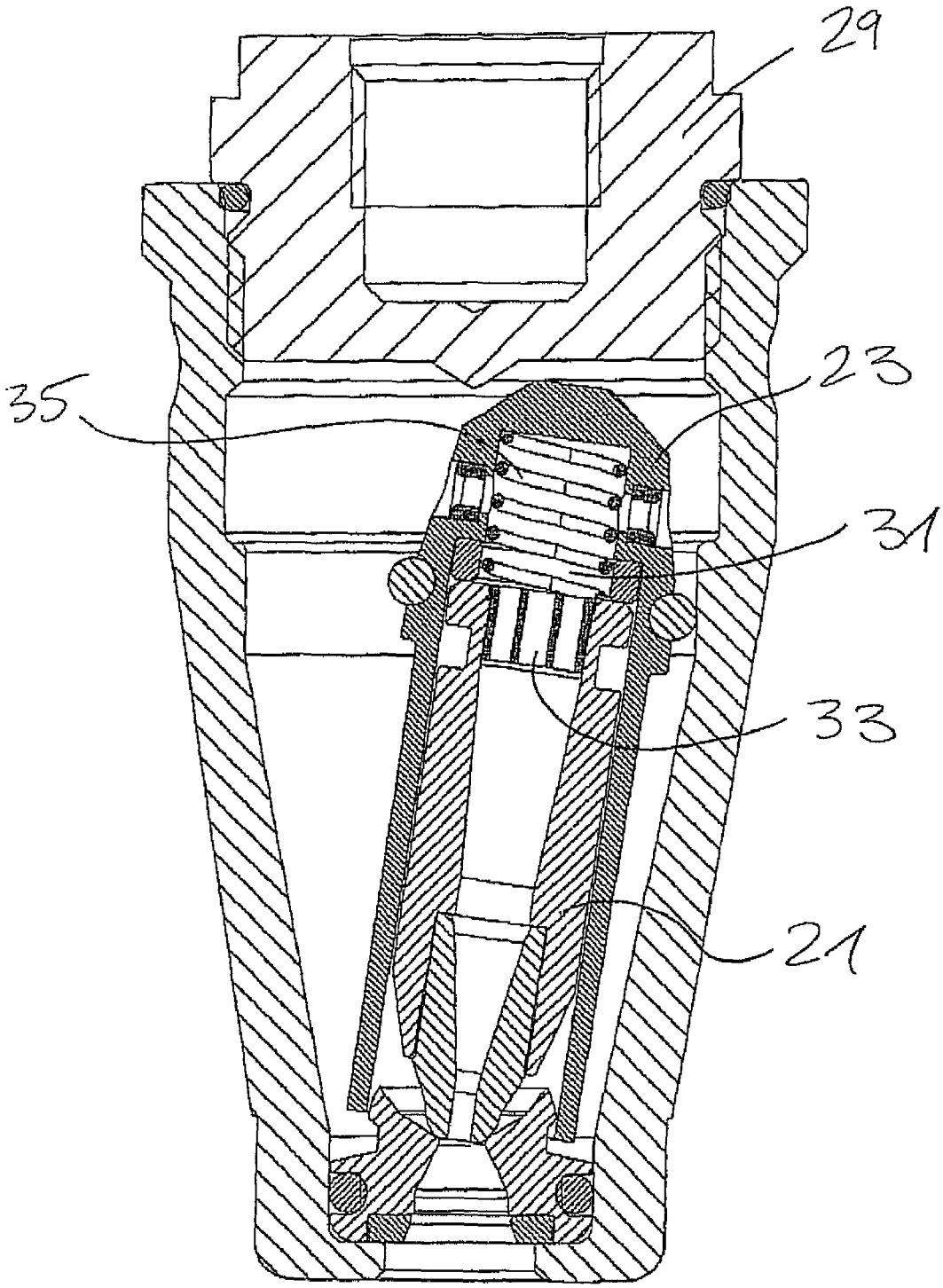
Figure 3:
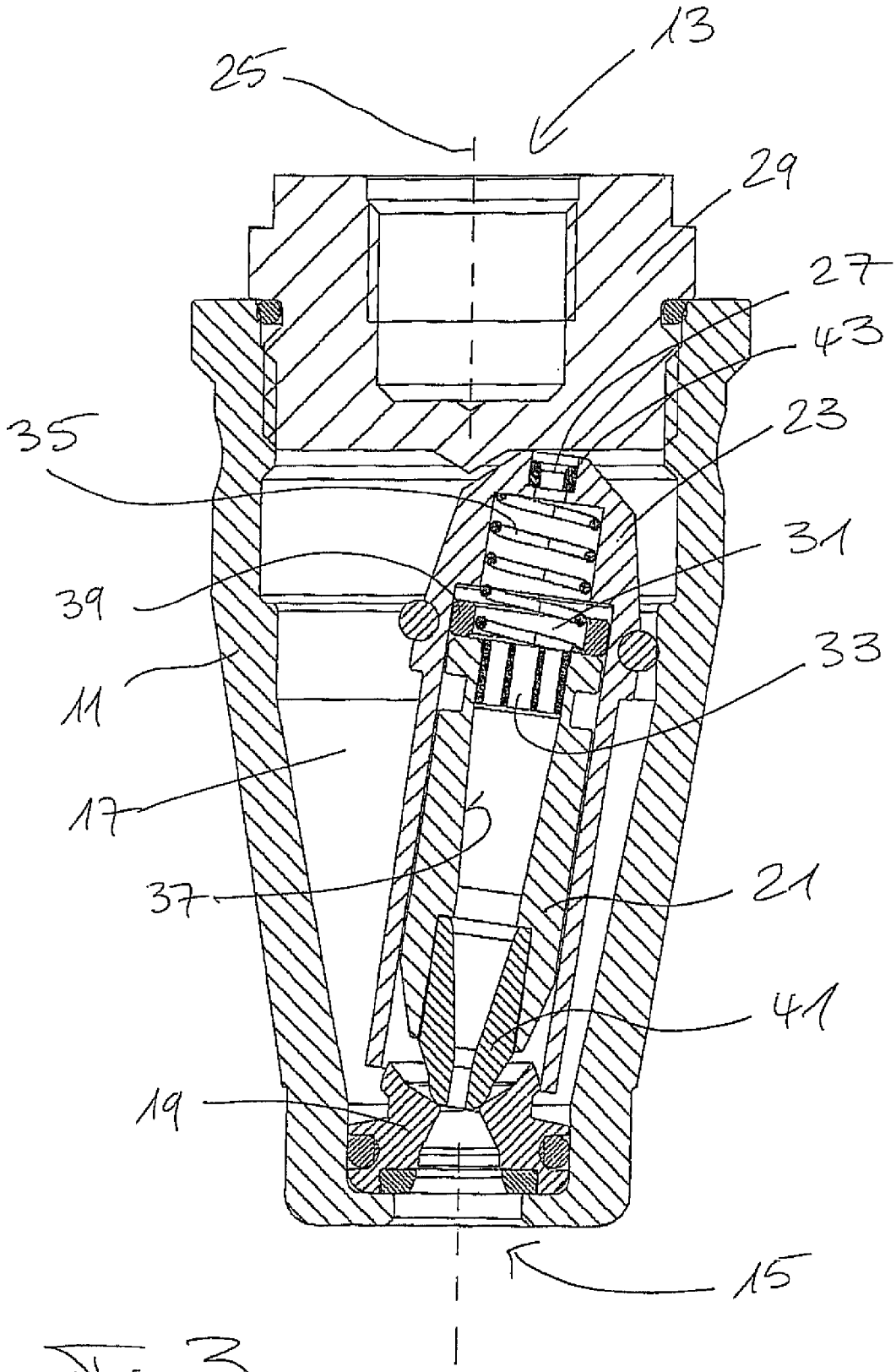
Figure 4:
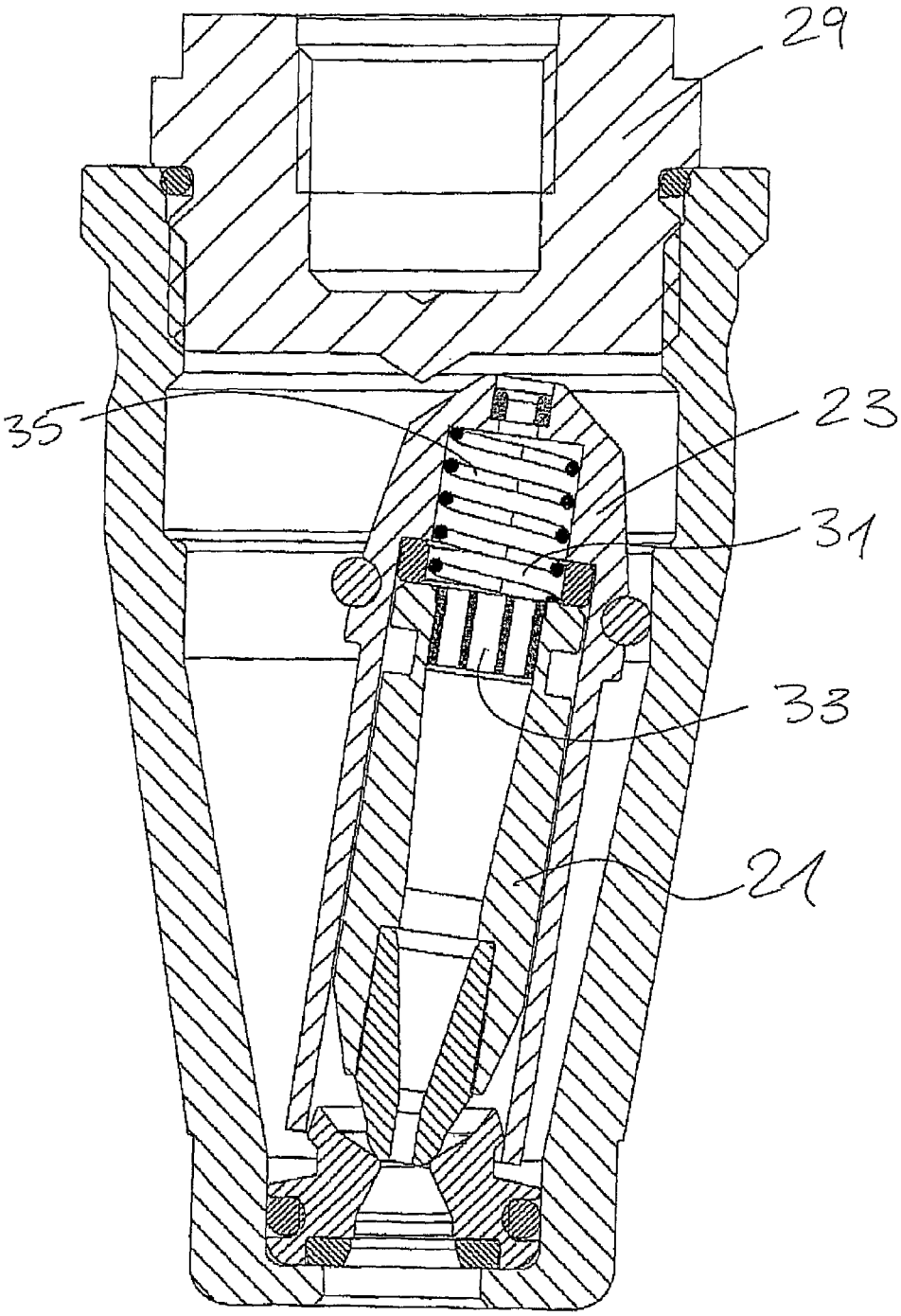

The invention will be described in the following by way of example with reference to the drawing. There are shown:

FIGS. 1 und 2 a rotor nozzle in accordance with an embodiment of the invention with a rotor in the stationary state (FIG. 1) or in the rotational state (FIG. 2); and FIGS. 3 und 4 a further embodiment of a rotor nozzle in accordance with the invention with a rotor in the stationary state (FIG. 3) or in the rotational state (FIG. 4).

DETAILED DESCRIPTION OF THE PREFERRED EMBODIMENTS

The basic design and the general operation of the rotor nozzles described in the following are known so that they will only be looked at briefly. A swirl chamber 17 also called a rotor space is formed in a nozzle housing 11. In the rear region, the nozzle housing 11 is closed by a connection plug 29 to which a supply line for the fluid, in particular water, can be connected. The fluid moves into the swirl chamber 17 via one or more inflow openings, not shown, of the plug 29 which open into the swirl chamber 17 with a radial and/or tangential component, whereby a swirl flow arises in the swirl chamber 17 which drives a rotor 21, 23 arranged in the swirl chamber 17 to a rotational movement around a longitudinal axis 25 of the nozzle housing which here coincides with a longitudinal axis of the swirl chamber 17.

The liquid moves out of the swirl chamber 17 into the rotor 21, 23—here via an inlet region 27 described in more detail in the following—and initially flows through the rotor and then out of the nozzle housing 11 via a nozzle made as a separate nozzle element 41 here at the front end of the rotor 21, 23 and via an outlet opening 15 formed in the nozzle housing 11. In this respect, the front end of the rotor 21, 23 is supported in a bearing 19 which is made in cup shape here and which is in particular made of ceramic material. Consequently, the liquid entering into the swirl chamber 17 and flowing through the rotor 21, 23 is expelled as a conical jet, with the conical jet being formed by a peripheral spot jet on a corresponding conical surface.

In both embodiments described here, the rotor is made in two parts and includes a front rotor part 21 as well as a rear rotor part 23 in the form of a sleeve which is pushed onto the front rotor part 21 such that the front end region of the sleeve 23, which does not have to be closed fully circumferentially, but can e.g. be made in the manner of a fork, engages around the cup bearing 19. The front rotor part 21 includes the already mentioned separate nozzle element 41 with which the rotor is supported at the cup bearing 19.

The rotor 21, 23 furthermore includes a central flow passage 37 which tapers in the direction of the front end, which is formed as throughgoing in the front rotor part 21 and which continues to the rear up to and into the sleeve 23 with the assembled rotor.

The sleeve 23 is closed in the rear region in the embodiment of FIGS. 1 and 2. An inlet region for the liquid coming from the swirl chamber 17 is formed in this embodiment by two mutually diametrically opposed passage openings 27 which are formed in a side wall of the sleeve 23. In the embodiment of FIGS. 3 and 4, in contrast, a central passage opening 27 is formed in the rear cover of the sleeve 23 closed laterally in the rear region, is disposed toward the rear in axial extension of the flow passage 37 and is provided as the inlet region for the liquid coming from the swirl chamber 17.

Apart from this difference in the design of the inlet region 27, the two rotor nozzles in accordance with the invention described by way of example here are made in the same construction.

An elastically deformable member in the form of a compression spring 35 is provided between the front rotor part 21 and the sleeve 23. The spring 35 endeavors to press apart the two rotor parts 21, 23 in the sense of an axial extension of the rotor. The rotor 21, 23 is hereby held tight or clamped between the cup bearing 19 and the connection plug 29 in a stationary state in accordance with FIG. 1 or FIG. 3 in which no liquid flows through the rotor nozzle, i.e. for example a connected high-pressure cleaning device is switched off.

A rectifier 33 cylindrical with respect to its outer shape is arranged in the rear region of the front rotor part 21. Such rectifier arrangements are generally known in connection with such rotor nozzles.

A ring-shaped end abutment 39 is arranged between the rear end side of the front rotor part 21 and a radially inwardly projecting shoulder of the sleeve 23. It determines the minimum length of the rotor 21, 23 which it adopts when—as will be looked at in more detail in the following—the sleeve 23 is pressed forward in the direction of the front end of the rotor, i.e. the spring 35 is compressed.

A respective ring-shaped insert 43 is arranged both in the two lateral inflow openings 27 in the embodiment of FIGS. 1 and 2 and in the rear axially aligned inflow opening 27 in the embodiment of FIGS. 3 and 4. This insert 43 is replaceable. The flow cross-section of the inlet openings 27 can be changed in this manner. The effective flow cross-section of the inlet region of the rotor 21, 23 formed by the openings 27 can thus be directly preset.

If, starting from the stationary state in accordance with FIG. 1 or FIG. 3, the rotor nozzle is charged with liquid, i.e., for example, a high-pressure cleaning device connected to the rotor nozzle is switched on, a so-called rotor flow is built up, that is a liquid flow from the swirl chamber 17 through the inflow openings 27 into the rotor 21, 23 and through the rotor 21, 23 and out of the nozzle housing 11 via the outlet opening 15. In this respect, the liquid initially flows from the inflow openings 27 to the rectifier 33, then through the rectifier 33 and subsequently in a rectified state through the front rotor part 21 and its nozzle element 41 in order finally to exit the rotor nozzle via the outlet opening 15 formed in the nozzle housing 11.

A negative pressure arises within the rotor due to the liquid flow or pressure relationships described above which has the consequence that the sleeve 23 is moved toward the front rotor part 21. The sleeve 23 is so-to-say pulled or sucked forward due to the rotor flow which is being built up. The rotor hereby becomes shorter so that the sleeve 23 moves out of engagement with the connection plug 29 serving as an abutment. The now no longer clamped or no longer held tight rotor 21, 23 whose front end is nevertheless, however, still in engagement with the cup bearing 19 is now in a position to rotate freely around the longitudinal axis 25 unimpeded by friction forces effective at its rear end.

Consequently, in accordance with the invention, the rotor 21, 23 remains securely held tight or clamped between the bearing 19 and the connection plug 29 for so long until flow conditions or pressure conditions prevail which ensure a proper rotational operation. The sleeve 23 in particular only moves out of engagement with the connection plug 29 when flow conditions or pressure conditions prevail which ensure that the front end of the rotor remains in the cup bearing 19, and in deed in particular also when work is carried out with the rotor head "overhead", i.e. the outlet opening 15 of the nozzle housing 11 faces perpendicularly or obliquely upwardly.

With such a working "overhead", there is the basic danger with conventional rotor nozzles that dirt particles enter into the region of the cup bearing 19 via the outlet opening 15 and are deposited between the cup bearing 19 and the front end of the rotor, which can result in impairments of the rotational operation and in particular in damage to the bearing 19. It is, in contrast, ensured in accordance with the invention by the clamping of the rotor 21, 23 until the switchover into the rotational state that the front end of the rotor is pressed into the bearing 19, whereby it is precluded that dirt particles can move between the bearing 19 and the rotor.

The switchover principle in accordance with the invention thus ensures a reliable start behavior of the rotor nozzle or of the rotor.

There are various possibilities to influence the switching behavior of the rotor 21, 23 or the conditions under which the switchover process is triggered. As already mentioned above, the flow cross-section of the inlet region formed by the passage opening or openings 27 can be varied. Alternatively or additionally, the spring constant of the spring 35 can be changed by providing a set of exchangeable springs. It is furthermore possible to use different rectifiers 33. The flow cross-section can furthermore be modified in a downstream region 31 between the passage opening(s) 27 and the rectifier 33.

Combinations of the setting measures or adjustment measures mentioned above are likewise possible.

It must generally be noted that not the whole rotor or not almost the whole rotor has to be flowed through by the liquid to generate the pressure relationships or flow relationships which provided the triggering of the switchover procedure. It would thus e.g. generally be possible to form the inlet region closer to the front end of the rotor. In particular neither the rectifier nor a region directly adjacent to the rectifier and disposed downstream of the inlet region is absolutely necessary to establish the required switchover relationships.

Other possibilities are furthermore conceivable to provide the switchover, i.e. to bring the rotor out of engagement with the abutment, while utilizing the arising pressure relationships and/or flow relationships. A pressure-controlled or flow-controlled relative movement of two or more components as provided in the two embodiments explained above is not compulsory in accordance with the invention. The rotor could, for example, have a section deformable in itself, e.g. a bellows-like or balloon-like section, whose outer shape is dependent on the prevailing pressure relationships or flow relationships and which contracts or collapses, for example, (and thus moves out of engagement with the abutment) when e.g. a corresponding negative pressure arises in the rotor.

The invention therefore includes very generally a pressure-controlled and/or flow-controlled switchover function for the rotor.

The invention claimed is:

1. A rotor nozzle, in particular for high-pressure cleaning devices, having a nozzle housing which has an inlet opening for liquid at its axially one end and an outlet opening for liquid at the other end as well as having a rotor which is arranged in a swirl chamber of the nozzle housing, which has a front end facing the outlet opening and supported at a bearing, which can be at least partly flowed through by the liquid, which can be set into rotation around a longitudinal axis by liquid flowing into the swirl chamber and which is inclined toward the longitudinal axis at least in the rotating state;

wherein the rotor has an inlet region for the liquid via which the liquid can move out of the swirl chamber into the rotor to allow a rotor flow of the liquid from the inlet region up to the front end of the rotor and out of the outlet opening;

wherein the rotor nozzle is capable of a switchover procedure between a stationary state in which the rotor is held tight between the bearing and an abutment and a rotational state in which the rotor is out of engagement with the abutment;

wherein the switchover procedure is triggerable by the rotor flow building up on the start-up of the rotor nozzle and/or by pressure relationships and/or flow relationships being adopted at and/or in the rotor; and wherein the rotor has at least one elastically deformable device whose deformation is accompanied by a length change of the rotor.

2. A rotor nozzle in accordance with claim 1, characterized in that the switchover procedure takes place by a length change of the rotor.

3. A rotor nozzle in accordance with claim 1, characterized in that the switchover procedure takes place by generation of a pressure difference by means of the rotor flow, with the pressure difference in particular arising within the rotor.

4. A rotor nozzle in accordance with claim 1, characterized in that the switchover procedure takes place by utilizing a venturi effect arising due to the rotor flow with the venturi effect in particular arising within the rotor.

5. A rotor nozzle in accordance with claim 1, characterized in that the conditions for the triggering of the switchover procedure can be changed among one another and can in particular be preset directly by modification of at least one rotor parameter or of a relationship of at least two rotor parameters.

6. A rotor nozzle in accordance with claim 5, characterized in that the rotor parameter is the flow cross-section of the inlet region of the rotor.

7. A rotor nozzle in accordance with claim 5, characterized in that the rotor parameter is the relationship between the flow cross-section of the inlet region of the rotor and the flow cross-section in a region of the rotor disposed downstream of the inlet region.

8. A rotor nozzle in accordance with claim 7, characterized in that the rotor has a rectifier and the downstream region is disposed in front of the rectifier.

9. A rotor nozzle in accordance with claim 5, characterized in that the rotor parameter is the deformation behavior of the elastically deformable device, in particular the spring constant of a spring forming the elastically deformable device.

10. A rotor nozzle in accordance with claim 9, characterized in that the elastically deformable device includes a spring.

11. A rotor nozzle in accordance with claim 1, characterized in that the elastically deformable device includes a spring.

12. A rotor nozzle in accordance with claim 1, characterized in that the rotor has a flow passage which extends at least from the inlet region up to the front end of the rotor.

13. A rotor nozzle in accordance with claim 12, characterized in that the flow passage is formed both in a front rotor part supported at the bearing and in a rear rotor part in engagement with the abutment in the stationary state.

14. A rotor nozzle in accordance with claim 12, characterized in that the inlet region has at least one passage opening which is in particular formed in a wall bounding the flow passage, in particular in a side wall or a rear cover.

15. A rotor nozzle in accordance with claim 14, characterized in that the passage opening extends transversely or parallel to the longitudinal extent of the rotor.

16. A rotor nozzle in accordance with claim 1, characterized in that the inlet region is formed at a rear rotor part in engagement with the abutment in the stationary state, in particular in a sleeve pushed onto the front rotor part.

17. A rotor nozzle in accordance with claim 1, characterized in that the abutment is formed by an axially rear boundary of the swirl chamber, in particular by a connection plug which can be pushed or screwed into the nozzle housing.

18. A rotor nozzle in accordance with claim 1, characterized in that the rotor includes an end abutment which defines a minimum length of the rotor.

19. A rotor nozzle in accordance with claim 1, characterized in that the switchover procedure takes place by utilizing a venturi effect arising due to the rotor flow with the venturi effect in particular arising within the rotor.

20. A rotor nozzle, in particular for high-pressure cleaning devices, having a nozzle housing which has an inlet opening for liquid at its axially one end and an outlet opening for liquid at the other end as well as having a rotor which is arranged in a swirl chamber of the nozzle housing, which has a front end facing the outlet opening and supported at a bearing, which can be at least partly flowed through by the liquid, which can be set into rotation around a longitudinal axis by liquid flowing into the swirl chamber and which is inclined toward the longitudinal axis at least in the rotating state;

wherein the rotor has an inlet region for the liquid via which the liquid can move out of the swirl chamber into the rotor to allow a rotor flow of the liquid from the inlet region up to the front end of the rotor and out of the outlet opening;

wherein the rotor nozzle is capable of a switchover procedure between a stationary state in which the rotor is held tight between the bearing and an abutment and a rotational state in which the rotor is out of engagement with the abutment;

wherein the switchover procedure is triggerable by the rotor flow building up on the start-up of the rotor nozzle and/or by pressure relationships and/or flow relationships being adopted at and/or in the rotor;

wherein the conditions for the triggering of the switchover procedure can be changed among one another and can in particular be preset directly by modification of at least one rotor parameter or of a relationship of at least two rotor parameters; and wherein the rotor parameter is the deformation behavior of the elastically deformable device, in particular the spring constant of a spring forming the elastically deformable device.

21. A rotor nozzle, in particular for high-pressure cleaning devices, having a nozzle housing which has an inlet opening for liquid at its axially one end and an outlet opening for liquid at the other end as well as having a rotor which is arranged in a swirl chamber of the nozzle housing, which has a front end facing the outlet opening and supported at a bearing, which can be at least partly flowed through by the liquid, which can be set into rotation around a longitudinal axis by liquid flowing into the swirl chamber and which is inclined toward the longitudinal axis at least in the rotating state;

wherein the rotor has an inlet region for the liquid via which the liquid can move out of the swirl chamber into the rotor to allow a rotor flow of the liquid from the inlet region up to the front end of the rotor and out of the outlet opening;

wherein the rotor nozzle is capable of a switchover procedure between a stationary state in which the rotor is held tight between the bearing and an abutment and a rotational state in which the rotor is out of engagement with the abutment;

wherein the switchover procedure is triggerable by the rotor flow building up on the start-up of the rotor nozzle and/or by pressure relationships and/or flow relationships being adopted at and/or in the rotor; and wherein the rotor includes a front rotor part and a rear rotor part which can be moved relative to one another in the sense of a length change of the rotor, with in particular an elastically deformable device being arranged between the front rotor part and the rear rotor part.

22. A rotor nozzle in accordance with claim 21, characterized in that the front rotor part is supported at the bearing.

23. A rotor nozzle in accordance with claim 21, characterized in that the rear rotor part is in engagement with the abutment in the stationary state.

24. A rotor nozzle in accordance with claim 21, characterized in that the rear rotor part includes a sleeve which is at least partly pushed onto the front rotor part.

25. A rotor nozzle in accordance with claim 24, characterized in that the sleeve engages around the bearing.

26. A rotor nozzle in accordance with claim 21, characterized in that the rotor flow building up on the start-up of the rotor nozzle effects a movement of the rear rotor part and of the front rotor part toward one another in the sense of a shortening of the length of the rotor, in particular with respect to the effect of an elastically deformable device.

27. A rotor nozzle in accordance with claim 21, characterized in that the rotor flow building up on the start-up of the rotor nozzle holds the front rotor part in engagement with the bearing and moves the rear rotor part in the direction of the front end of the rotor away from the abutment.

* * * * *